US006492076B1

(12) United States Patent
Goswami et al.

(10) Patent No.: US 6,492,076 B1
(45) Date of Patent: Dec. 10, 2002

(54) THERMALLY BLEACHABLE DYE FOR A COLOR PHOTOTHERMOGRAPHIC ELEMENT

(75) Inventors: Ramanuj Goswami, Webster, NY (US); Mark E. Irving, Rochester, NY (US); David H. Levy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/940,204

(22) Filed: Aug. 27, 2001

(51) Int. Cl.[7] ..... G03C 1/498; G03C 1/815

(52) U.S. Cl. ..... 430/21; 430/351; 430/502; 430/510; 430/511; 430/513; 430/517; 430/522; 430/566; 430/617; 430/619; 430/959; 430/964

(58) Field of Search ..... 430/619, 617, 430/203, 351, 21, 566, 502, 510, 511, 513, 959, 964, 522, 517

(56) References Cited

U.S. PATENT DOCUMENTS 3,619,194 A 11/1971 Mitchell
4,789,623 A * 12/1988 Sato et al. ..... 430/351

FOREIGN PATENT DOCUMENTS

EP 0800114 * 10/1997 ..... G03C/8/40

* cited by examiner

*Primary Examiner*—Thorl Chea
(74) *Attorney, Agent, or Firm*—Chris P. Konkol

(57) ABSTRACT

This invention relates to a color photothermographic element comprising a support, at least one photothermographic imaging layer, and at least one antihalation layer or filter layer, wherein the antihalation or filer layer comprises an aqueous heat-bleachable composition comprising at least one zwitterionic 1-aminopyridinium dye having a methine linkage terminated by a substituted or unsubstituted heterocyclic nucleus.

25 Claims, No Drawings

THERMALLY BLEACHABLE DYE FOR A COLOR PHOTOTHERMOGRAPHIC ELEMENT

FIELD OF THE INVENTION

This invention relates to colored, aqueous heat-bleachable compositions that can undergo a change in electromagnetic absorption characteristics upon application of heat. These compositions are useful as antihalation or filter components of photothermnographic elements. In particular, zwitterionic 1-aminopyridinium dyes have been found to provide improved bleaching characteristics in photothermographic elements.

BACKGROUND OF THE INVENTION

Photographic materials usually contain various layers and components, including antihalation or filter layers, overcoats and radiation sensitive layers. The antihalation layer of an imaging element helps to prevent light that has passed through the radiation sensitive layer(s) from reflecting back into those layers. If reflection is not prevented, the resulting image is less sharp. In wet processes, the antihalation layer is generally removed or rendered colorless during wet-chemical processing. A filter layer is used to absorb light of a color not completely absorbed by a color layer or color layer unit above the filter layer, while transmitting light of a color intended to be absorbed by a color layer or a color layer below the filter layer. In other words, a filter layer is used to selectively absorb light not used for image capture. An antihalation layer can be viewed as a type of filter layer positioned below all the color layers, wherein no light needs to be transmitted to any color layer below the antihalation layer, but reflection of light back through the antihalation unit is prevented or minimized. Both an antihalation layer and a filter layer will typically employ a filter dye which absorbs, or filters out, light not intended to be absorbed by a color layer.

Imaging elements that can be processed, after imagewise exposure, simply by heating the element are referred to as photothermographic elements. It is often desired that such elements include an antihalation or filter layer. In most cases, the antihalation layer must be rendered substantially transparent upon heat processing in order to avoid unwanted absorption of light during scanning, which would undesirably result in a higher level of minimum density (an increased "$D_{min}$"). Particularly in the case of a color film, bleaching to transparency and avoiding or minimizing any tint is desirable.

It is generally desirable to employ light-filtering dyes which can be quickly and readily rendered ineffective, i.e., decolorized or destroyed and removed prior to or during or after photographic processing. For conventional processing of conventional film, it has been found to be particularly convenient to employ dyes which are rendered ineffective by one of the photographic baths used in processing the exposed element, such as a photographic developer or fixer. The de-coloration or destruction of a light-absorbing dye will hereinafter be referred to as bleaching.

Prior-art dyes having desirable absorption characteristics have not always had good thermal bleaching characteristics. Some of these dyes have been subject to undesirable stains in the visible images made from photographic elements containing the dyes. Other dyes have not had the desired stability that is required for normal storage of the photographic element. Many dry photographic processes, that is, those photographic processes that require no liquids for the preparation of a visible image, have employed light-absorbing dyes that could only be removed by subjecting them to some form of liquid treatment, for example, an acid bath or an alkaline bath. Many of these dry processes lose a good part of their attractiveness when liquids are required for the dye removal. Typical processes employing prior art light-absorbing layers are described in U.S. Pat. Nos. 3,260,601 and 3,282,699.

Furthermore, many if not most of the bleachable antihalation compositions in the prior art were designed for solvent systems in which the dyes and the bleaching agents were soluble as individual molecules. Furthermore, most of the bleachable antihalation compositions in the prior art have been directed to health imaging or graphic arts (monochrome systems), as compared to photothermographic color film for consumer use. In the latter context, the dark keeping of a thermally bleachable dye composition is a challenge. For such compositions to be useful, it would be important that they have the least amount of dark-keeping loss, while at the same time undergo almost complete bleaching at higher temperatures.

A variety of antihalation compositions have been reported in the literature for use in photothermographic systems that avoid the use of processing solutions. Such compositions generally include heat-bleachable antihalation dyes or incorporated addenda that act as bleaching agents. Furthermore, many if not most prior arts (references cited below) describing thermally bleachable dye compositions use many-fold excesses of the bleaching reagents to decolorize the dyes. For example, prior patents teaching the use of excess of bleaching reagents: include, for example, Fuji EP 911,693 A1, DuPont U.S. Pat. No. 5,312,721, 3M U.S. Pat. No. 5,258,274, and Kodak U.S. Pat. Nos. 4,201,590, 4,196,002, and 4,081,278.

Prior art not using bleaching reagents to decolorize the dyes is very limited. Dyes containing 1-aminopyridinium nucleus represent one such class of dyes. In particular, the use of 1-aminopyridinium dyes in antihalation or filter compositions for photographic imaging systems is known, being described in U.S. Pat. No. 3,619,194 (Mitchell). Various substituents on the dyes are listed in column 4 of the patent, including carboxyalkyl and sulfoalkyl that would comprise a zwitterionic compound. The examples, however, disclose the non-zwitterionic perchlorate, tetrafluoroborate or similar salt forms of the cyanine type of 1-aminopytidinium dyes. But these dyes, as disclosed in this prior art, are not useful as they do not bleach efficiently enough at acceptable processing temperatures.

PROBLEM TO BE SOLVED BY THE INVENTION

There is a need for antihalation compositions that can be permanently and quickly bleached at lower temperatures in aqueous systems. Particularly in the field of color photothermographic film for consumer use, the requirements in terms of bleaching and keeping are high. Bleaching of an antihalation layer or filter-dye layer is desired to improve scanning of the film.

Also, the need to use excesses of bleaching reagents in a bleachable AHU or filter layer adds to the cost of thermally bleachable dye compositions. It would be desirable to obtain useful AHU dyes that do not require excessive amounts of bleaching reagents to undergo decolorization. Most preferable are the dyes that do not need any additional reagents to undergo successful bleaching and yet have good keeping characteristics.

SUMMARY OF THE INVENTION

The present invention relates to a photothermographic element comprising a support, at least one photothermographic layer, and at least one antihalation layer or a filter layer, wherein the antihalation or filer layer comprises a heat-bleachable composition comprising at least one light-absorbing filter dye that is a zwitterionic 1-aminopyridinium dye comprising a methine linkage terminated by a substituted or unsubstituted heterocyclic nucleus of the type contained in cyanine dyes.

The term "filter dye" encompasses dyes used in filter layers or antihalation layers and excludes dyes resulting from developing agents or coupling agents. In one embodiment of the invention, the particles are dispersed in a matrix comprising a hydrophilic polymer or water-dispersible hydrophobic polymer.

The invention is also directed to a method of making a photothermographic element and the use of the photothermographic element, wherein the antihalation or filter layer becomes at least 40%, preferably at least 50%, more preferably at least 90%, colorless within about 20 minutes, preferably within about 5 minutes, more preferably within about 0.5 minutes, upon heating to a temperature of at least about 90° C. (according to controlled tests of such a layer essentially alone on the same support used in the product). The described antihalation or filter layer is especially advantageous because of the speed with which the layer becomes at least 40% colorless upon heating and its good shelf life storage stability. Preferred embodiments provide thermal bleaching of greater than 75% in less than 20 seconds at a temperature below 170° C.

The invention is also directed to a method of forming an image in the multicolor photothermographic element, including scanning the developed image.

DETAILED DESCRIPTION OF THE INVENTION

As indicated above, a feature of the invention is the use, in a photothermographic element of a filter or antihalation layer comprising a zwitterionic 1-aminopyridinium filter dye having a methine linkage terminated by a substituted or unsubstituted heterocyclic nucleus of the type contained in cyanine dyes, e.g., those set forth in Mees and James, The Theory of the Photographic Process, MacMillan, 4th ed. pp. 194–290, hereby incorporated by reference.

In general, when reference in this application is made to a particular moiety or group it is to be understood that such reference encompasses that moiety whether unsubstituted or substituted with one or more substituents (up to the maximum possible number). For example, "alkyl" or "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; hydroxy; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl), thioalkyl (for example, methylthio or ethylthio), particularly either of those with 1 to 6 carbon atoms; substituted or unsubstituted alkenyl, preferably of 2 to 10 carbon atoms (for example, ethenyl, propenyl, or butenyl); substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; hydroxylate, amino, alkylamino, cyano, nitro, carboxy, carboxylate, acyl, alkoxycarbonyl, aminocarbonyl, sulfonamido, sulfamoyl, sulfo, sulfonate, alkylammonium, and an ionizable group with a pKa value below 4 in water; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

In a preferred embodiment of the present invention, the filter dye is represented by the following formulae:

I

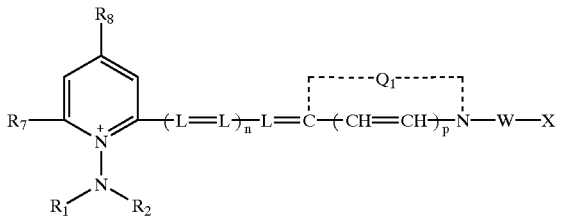

wherein:

$R_1$ and $R_2$ can be either:

(a) an alkyl group, preferably having one to eight carbon atoms such as methyl, ethyl, propyl, butyl, etc. including a substituted alkyl radical such as aralkyl, e.g., benzyl, hydroxyalkyl such as hydroxypropyl, hydroxyethyl; etc.;

(b) an acyl group, e.g.,

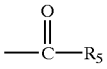

including a thioacyl group, e.g.,

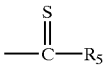

wherein $R_5$ is an alkyl group preferably having one to eight carbon atoms such as methyl, ethyl, propyl, butyl, etc., an aryl group such as phenyl, naphthyl, tolyl, etc., an alkoxy group containing one to eight carbon atoms such as methoxy, ethoxy, butoxy, isobutoxy, etc., an amino group such as arylamino, alkylamino, etc., a heterocyclic nucleus containing five to six members at least one of which is oxygen, sulfur or nitrogen such as a pyridine nucleus, a quinoline nucleus, etc., (c) an aryl radical including a substituted aryl radical, e.g., phenyl, naphthyl, tolyl, hydroxyphenyl, halophenyl such as chlorophenyl, 2,4,6-trichlorophenyl, nitrophenyl, carboxyphenyl, alkoxyphenyl such as methoxyphenyl, ethoxyphenyl, etc.;

(d) a heterocyclic nucleus containing five to six members in the nucleus at least one member being a nitrogen, sulfur, selenium or oxygen atom including a substituted heterocyclic nucleus such as a pyridine nucleus, a quinoline nucleus, a benzothiazole nucleus, etc., (e) joined together to complete a five to six membered heterocyclic nucleus including a substituted heterocyclic nucleus such as a 4H-1,2,4-triazolyl, an alkyl substituted 4H-1,2,4-triazolyl, an aryl substituted 4H-1,2,4-triazolyl, a morpholino group, an imidazole group, a piperidino group, a pyrrole group, a pyrrolidino group, etc.;

$Q_1$ represents the non-metallic atoms necessary to complete a (saturated, unsaturated, or aromatic) heterocyclic nucleus containing five to ten atoms in the heterocyclic ring (including fused heterocyclic ring structures), which nucleus can contain at least one additional hetero atom such as oxygen, sulfur, selenium or nitrogen, i.e., a nucleus of the type used in the production of cyanine dyes, and which heterocyclic nucleus can be substituted or unsubstituted by up to 5 independently selected substituents, preferably 0 to 3 substituents, such as the following representative substituted or unsubstituted nuclei: a thiazole nucleus, which may be substituted, e.g., thiazole, 4-methylthiazole, 3-ethylthiazole, 4-phenylthiazole, 5-methylthiazole, 5-phenylthiazole, 4,5-dimethylthiazole, 4,5-diphenylthiazole, 4-(2-thienyl)-thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 6-nitrobenzothiazole, 5-bromobenzothiazole, 6-bromobenzothiazole, 5-chloro-6-nitrobenzothiazole, 4-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, a tetrahydrobenzothiazole nucleus, which may be substitued, e.g., 5,6-dimethoxybenzothiazole, 5,6-methyl enedioxybenzothi azole, 5-hydroxybenzothiazole, 6-hydroxybenzothiazole; a naphthothiazole nucleus, alpha -naphthothiazole, beta-naphthothiazole, beta, beta-naphthothiazole, which nucleus can be substituted, for example, 5-methoxy-beta, beta-naphthothiazole, 5-ethoxy- beta-naphthothiazole, 8-methoxy-alpha-naphthothiazole, 7-methoxy-alpha-naphthothiazole, 4'-methoxythianaphtheno-7',6',4,5-thiazole, nitro group substituted naphthothiazoles, etc., an oxazole or benzoxazole or naphthoxazole nucleus, which may be substituted, e.g., 4-methyloxazole, 4-nitro-oxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 5- or 6-nitrobenzoxazole, 5-chloro-6-nitrobenzoxazole, 6-methylbenzoxazole, 5,6-dimethylbenzoxazole, 4,6-dimethylbenzoxazole, 5-methoxybenzoxazole, 5-ethoxybenzoxazole, 5-chlorobenzoxazole, 6-methoxybenzoxazole, 5-hydroxybenzoxazole, 6-hydroxybenzoxazole, alpha-naphthoxazole, beta-naphthoxazole, nitro group substituted naphthoxazoles, etc., a selenazole or benzoselenazole or naphthoselenazole nucleus, which may be substituted, e.g., 4-methylselenazole, 4-nitroselenazole, 4-phenylselenazole, benzoselenazole, 5-chlorobenzoselenazole, 5-methoxybenzoselenazole, 5-hydroxybenzoselenazole, 5- or 6-nitrobenzoselenazole, 5-chloro-6-nitrobenzoselenazole, tetrahydrobenzoselenazole, alpha-naphthoselenazole, beta-naphthoselenazole, nitro group substituted naphthoselenazoles, etc.; an oxazoline nucleus, which may be substituted, e.g., 4,4-dimethyloxazoline, etc.; a thiazoline nucleus, which may be subsituted, e.g., 4-methylthiazoline, etc.; a pyridine nucleus, which may be substituted, e.g., 2-pyridine, 5-methyl-2-pyridine, 4-pyridine, 3-methyl-4-pyryridines, nitro group substituted pyridines, etc.; a quinoline nucleus, which may be substituted, e.g., 2-quinoline, 3-methyl-2-quinoline, 6-methyl-2-quinoline, 6-chloro-2-quinoline, 6-nitro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 6-nitro-4-quinoline, 7-methyl-4-quinoline, 8-chloro-4-quinoline, 1-isoquinoline, 6-nitro-1-isoquinoline, 3,4-dihydro-1-isoquinoline, 3-isoquinoline, etc.; a 3,3-dialkylindolenine nucleus, typically having a nitro or cyano substituent, e.g., 3,3-dimethyl-5 or 6-nitroindolenine, 3,3-dimethyl-5 or 6-cyanoindolenine, etc.; and, an imidazole or benzimidazole or naphthimidazole nucleus, which may be substituted, e.g., 1-alkylimidazole, 1-alkyl-4-phenylimidazole, 1-alkyl-4,5-dimethylimidazole, benzimidazole, 1-alkylbenzimidazole, 1-alkyl-5-nitrobenzimidazole, 1-aryl-5,6-dichlorobenzimidazole, 1-alkyl-alpha-naphthimidazole, 1-aryl-beta-naphthimidazole, 1-alkyl-5-methoxy-alpha-naphthimidazole, or, an imidazo[4,5-b]quinoxaline nucleus, which may be substituted, e.g., 1-alkylimidazo[4,5-b]quinoxaline such as 1-ethylimidazo[4,5-b]quinoxaline, 6-chloro-1-ethylimidazo[4,5-b]quinoxaline, etc., 1-alkenylimidazo[4,5-b]quinoxaline such as 1-allylimidazo[4,5-b]quinoxaline, 6-chloro-1-allylimidazo[4,5-b]quinoxaline, etc., 1-arylimidazo[4,5-b]quinoxaline such as 1-phenylimidazo[4,5-b]quinoxaline, 6-chloro-1-phenylimidazo[4,5-b]quinoxaline, etc.; a 3,3-dialkyl-3H-pyrrolo[2,3-b]pyridine, e.g., 3,3-dimethyl-3H-pyrrolo[2,3-b]pyridine, 3,3-diethyl-3H-pyrrolo[2,3-b]pyridine, etc.; a substituted or unsubstituted thiazolo[4,5-b]quinoline nucleus; an indolyl nucleus including substituted indolyl nuclei such as a 2-phenyl-3-indole, 1-methyl-2-phenyl-3-indole; and the like. Preferred substituents are alkyl, aryl, alkoxy, and heterocyclic, all preferably having 1 to 12 carbon atoms, halogen, hydroxy, and nitro.

W is a linking group, preferably a substituted or unsubstituted alkylene (preferably a lower alkylene containing from one to four carbon atoms), e.g., methylene, ethylene, propylene, isopropylene, butylene, hexylene, cyclohexylene, etc., substituted alkylene groups such as a hydroxyalkylene group, e.g., beta-hydroxyethylene, omega-hychoxybutylene, etc., an alkoxyalkylene group, e.g., beta-methoxyethylene, omega-butoxybutylene, etc., an acyloxy-alkylene group, e.g., beta-acetoxyethylene, gamma-acetoxypropylene, omega-butyryloxybutylene, etc., an alkoxycarbonylalkylene group, e.g., beta-methoxycarbonylethylene, omega-ethoxycarbonylbutylene, etc. or an aralkylene group, e.g., benzylene, phenethylene, etc.; an alkenylene group, e.g., allylene, 1-propenylene, 2-butenylene, etc., or an arylene group, e.g., phenylene, tolyene, naphthylene, methoxyphenylene, chlorophenylene, etc.

X represents an anionic group including a sulfate, phosphate, sulfonate, phosphonate and carboxyl group. Preferably X is a sulfonate group —$SO_3$ n is one or two;

p represents the number of double bonds in the heterocylic ring between the N atom and the first methine linkage and is zero or one, preferably 0;

L represents a methine linkage having the formula

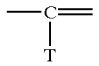

wherein T can be hydrogen, halogen, carboxyamide, lower alkyl of one to four carbon atoms or aryl such as phenyl, e.g., —CH , —C($CH_3$) , —C($C_6H_5$) , etc.;

$R_7$ and $R_8$ each can be (1) a hydrogen atom, (2) an alkyl group (preferably a lower alkyl containing from one to four carbon atoms) including a substituted alkyl group such as aralkyl, hydroxyalkyl, e.g., methyl, ethyl, propyl, isopropyl, butyl, tert-butyl, dodecyl, benzyl, hydroxypropyl, hydroxyethyl, etc. or (3) an aryl group including a substituted aryl group such as an alkaryl, haloaryl, alkoxyaryl, aminoalyl, etc. e.g., phenyl, tolyl, naphthyl, methoxyphenyl, chlorophenyl, diethylaminophenyl, etc., The preferred light-absorbing photographic layers of this invention contain 1-aminopyridinium dyes having one of the following structures:

II

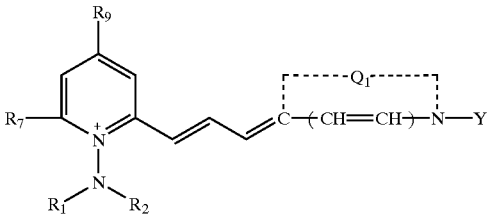

wherein $Q_1$, $R_1$, $R_2$, $R_7$ and $R_8$ are as defined and Y is a sulfoalkyl, carboxyalkyl, or phosphoalkyl group, in which Y preferably has 1 to 4 carbon atoms.

More preferably, light-absorbing photothenmographic layers of this invention contain 1-aminopyridinium dyes having the following structure:

III

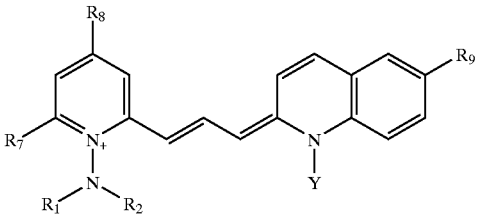

wherein $R_1$, $R_2$, $R_7$, $R_8$, and Y are as defined above and $R_9$ is hydrogen, substituted or unsubstituted alkyl, substituted or unsubstituted alkoxy, substituted or unsubstituted aryl or alkylaryl, nitro, hydroxy, or halogen, which carbon containing groups preferably have 1 to 8 carbon atoms.

More preferably, the zwitterionic 1-aminopyridinium dye is represented by Structure IV:

IV

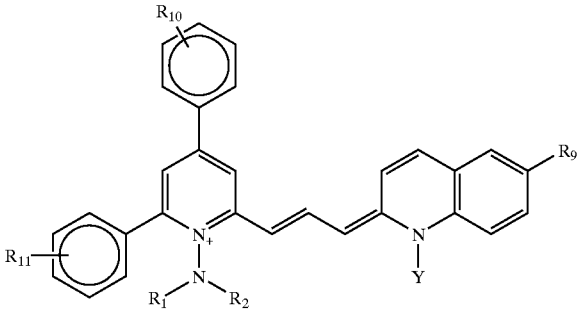

wherein $R_1$, $R_2$, $R_7$, $R_8$, $R_9$ and Y are as defined above and $R_{10}$ and $R_{11}$ are independently selected from the $R_9$ groups mentioned above.

A representative 1-aminopyridiniume compound according to the present invention is as follows:

DI-1

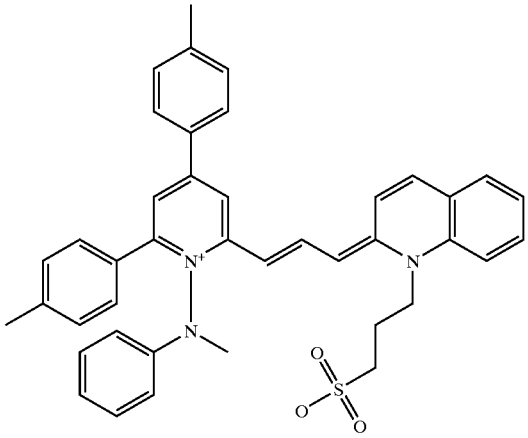

Another aspect of the present invention is the use of N-arninopyridiniumcarbocyanine dyes in reactive association with the melt-formers. In one embodiment, the bleachable AHU Composition containing the above dye in combination with salicylanilide.

If desired, a combination of 1-aminopyridinium compounds can be used. Selection of the 1-aminopyridinium dye or combination of such compounds will depend upon such factors as the processing conditions, desired degree of bleaching in the layer containing the dye or dyes, solubility characteristics of the components, absorption spectra, and the like.

For antihalation layer purposes, it is desirable that the heat bleachable layer have substantially uniform absorption in the spectral region in which the imaging composition is sensitive. The antihalation dye or dye precursor should also be changed to the extent that at least about 40%, and preferably at least 50%, more preferably at least 60%, still more preferably at least 80%, and most preferably at least 90% of the layer absorption is changed from colored to colorless according to a standard test using Status M density. Thus, the antihalation or filter layer, after bleaching, has minimal or substantially no optical density that will adversely affect the Dmin of the product during scanning, or during overall picture production using the photothermographic element.

More than one filter dye can be used in the same AHU or filter layer. Combinations of different filter dyes can be used in the same layer or in different layers, depending on the purpose of the dye. Preferably, the filter dyes useful in an antihalation layer according to the present invention absorbs mainly from about 400 to about 850 nm. Preferably, the dyes absorbing mainly (and relatively uniformly) at from about 500 to about 850 nm are used. In the case of filter layers, a yellow filter dye useful in an yellow filter layer according to the present invention absorbs mainly from about 400 to about 500 nm and will transmit most of the light in the range 500 to 850 nm. Preferably, a yellow filter dye will absorb mainly at from about 420 to about 480 nm and will transmit most of the light in the range 490 to 850 nm. Similarly, a magenta filter dye will absorb light mostly from 500 to 600 nm and preferably from 520 to 580 nm while transmitting most of the light shorter than 500 nm and longer than 600 nm.

The photothermographic elements containing the filter dyes of the present invention is that the layers are irreversibly bleached upon exposure to heat of adequate intensity, including dry processing.

The filter dyes of the present invention have good incubation stability, allowing their incorporation into elements requiring prolonged storage. The dyes contained in the novel photothermographic elements of this invention are irreversibly bleached upon exposure. The amount of heat required to cause bleaching of the layers is somewhat dependent upon the particular dye incorporated in the layer; higher temperatures require shorter times to bring about bleaching while lower temperatures require longer times. Generally, temperatures of at least 100° C. for a period of at least 5 seconds are required to bring about any noticeable bleaching. For color photothermography, temperatures of 130° C. and above and times in excess of 10 seconds are generally preferred.

The dyes incorporated in the novel layers of this invention are characterized by their good spectral absorption properties. The maximum absorption of the various individual dyes ranges throughout the visible regions of the spectrum. Also, the dyes are further characterized by the fact that they are readily incorporated in hydrophilic layers used in photographic elements. The dyes are soluble in most of the common organic solvents including halogenated aliphatic hydrocarbons such as chloroform, ketones such as acetone, aliphatic alcohols such as methanol, ethanol, etc., amides such as dimethylfoimamide, nitrogen-containing heterocyclic solvents such as pyridine, etc. The dyes may also be mordanted with basic mordants where desired.

The dyes described herein are valuable for use in photothermographic light-sensitive material employing one or more sensitive silver halide layers. The dyes can be used to make light-absorbing layers including antihalation as well as filter layers with or without dyes of other classes and can be incorporated readily in colloidal binders used for forming such layers. They are especially useful in gelatin layers lying adjacent to silver halide layers, since they can be mordanted with organic polymeric substances having excellent non-wandering characteristics in gelatin. The dyes can also be readily bleached without removing the layers containing them. Furthermore, they can be mordanted in layers coated in contact with light-sensitive silver halide emulsion layers since the mordanted dyes have very good stability at the pH of the most sensitive silver halide emulsions and have little or no undesirable effect on the silver halide itself. As a result, the dyes can be used as light-absorbing dyes in layers coated directly on top of the sensitive silver halide emulsion layers or between two sensitive silver halide emulsion layers or between the support and a sensitive silver halide emulsion layers or between the support and a sensitive silver halide emulsion layer or on the back of a support as an antihalation layer.

The photographic elements prepared according to the instant invention can be used in various kinds of photothermographic systems. In addition to being useful in X-ray and other non-optically sensitized systems, they can also be used in orthochromatic, panchromatic and infrared sensitive systems. The sensitizing addenda can be added to photographic systems before or after any sensitizing dyes which are used.

The dyes of this invention can be used in emulsions intended for color photothermography, for example, emulsions containing color-forming couplers or emulsions to be developed by solutions containing couplers or other color-generating materials, emulsions of the mixed-packet type such as described in U.S. Pat. No. 2,698,794 of Godowsky issued Jan. 4, 1955; in silver dye-bleach systems, and emulsions of the mixed-grain type such as described in U.S. Pat. No. 2,592,243 of Carroll and Hanson issued Apr. 8, 1952.

Photographic layers containing the dyes of this invention can be used in diffusion transfer processes which utilize undeveloped silver halide in the non-image areas of the negative to form a positive by dissolving the undeveloped silver halide and precipitating it on a receiving layer in close proximity to the original silver halide emulsion layer. Such processes are described in Rott, U.S. Pat. No. 2,352,014, Land U.S. Pat. No. 2,543,181 and Yackel et al. U.S. Pat. No. 3,020,155. Photographic layers containing the dyes of this invention can also be used in color transfer processes which utilize the diffusion transfer of an imagewise distribution of developer, coupler or dye from a light-sensitive layer to a second layer while the two layers are in close proximity to one another. Color transfer processes of this type are described in Yutzy, U.S. Pat. No. 2,856,142, Land et al. U.S. Pat. No. 2,983,606; Whitmore et al. British Pat. Nos. 904, 364 and 840,731; and Whitmore et al. U.S. Pat. No. 3,227, 552.

In general, intermediates for, the dyes incorporated in the light-absorbing layers are obtained by reacting an appropriate hydrazine with a pyrylium salt. Representative dyes and intermediates used in the layers of this invention and their methods of preparation are illustrated by the following examples which are not intended to limit the invention.

Depending on the choice of the filter dye, it can be in the antihalation or filter layer in the form of solid particles, dissolved in a dispersed organic phase, emulsified, or dissolved in the aqueous matrix of the antihalation or filter layer. Although dissolving a water-soluble dye in the aqueous matrix is easiest, it is not universally preferred since one would generally prefer that the dye remain in the layer in which it was coated.

The coverages and proportions of the components which comprise the described antihalation or filter component of the present invention can vary over wide ranges depending upon such factors as the particular use, location in the element of the antihalation or filter component, the desired degree of absorption, processing temperatures, and the like. For example, in some photothermographic elements the concentration of dye is sufficient to provide a peak optical density of at least about 0.05. For antihalation purposes, it is desirable that the concentration of the dye be sufficient to provide an optical density of at least about 0.2 such as about 0.3 to about 2.0, throughout the visible spectrum. Particles of the 1-aminopyridinium filter dyes can be made by conventional dispersion techniques, such as milling, by preparing the particles by a limited coalescence procedure, or other procedures known in the art. Milling processes that can be used include, for example, processes described in U.K. Pat. No. 1,570,632, and U.S. Pat. Nos. 3,676,147, 4,006,025, 4,474,872 and 4,948,718, the entire disclosures of which are incorporate herein by reference. Limited coalescence procedures that can be used include, for example, the procedures described in U.S. Pat. Nos. 4,994,3132, 5,055,371, 2,932,629, 2,394,530, 4,833,060, 4,834,084, 4,965,131 and 5,354,799, the entire disclosures of which are incorporated herein by reference. A suitable average size of the particles are 10 to 5000 nm, preferably 20 to 1000 nm, most preferably 30 to 500 nm.

In a preferred embodiment, the 1-aminopyridinium filter dye is dispersed in the binder in the form of a solid particle dispersion. Such dispersions can be formed by either milling the dye in solid form until the desired particle size range is reached, or by precipitating (from a solvent solution) the dye directly in the form of a solid particle dispersion. In the case of solid particle milling dispersal methods, a coarse aqueous premix, containing the 1-aminopyridinium compound and water, and optionally, any desired combination of water soluble surfactants and polymers, is made, and added to this premix prior to the milling operation. The resulting mixture is then loaded into a mill. The mill can be, for example, a ball mill, media mill, jet mill, attritor mill, vibratory mill, or the like. The mill is charged with the appropriate milling media such as, for example, beads of silica, silicon nitride, sand, zirconium oxide, yttria-stabilized zirconium oxide, alumina, titanium, glass, polystyrene, etc. The bead sizes typically range from 0.25 to 3.0 mm in diameter, but smaller media may be used if desired. The solid 1-aminopyridinium in the slurry are subjected to repeated collisions with the milling media, resulting in crystal fracture and consequent particle size reduction.

The aqueous dispersion can further contain appropriate surfactants and polymers previously disclosed for use in making pH precipitated dispersions. For solvent precipitation, a solution of the dye is made in some water miscible, organic solvent. The solution of the dye is added to an aqueous solution containing appropriate surfactants and polymers to cause precipitation as previously disclosed for use in making solvent precipitated dispersions.

Surfactants and other additional conventional addenda may also be used in the dispersing process described herein in accordance with prior art solid particle dispersing procedures. Such surfactants, polymers and other addenda are disclosed in U.S. Pat. Nos. 5,468,598, 5,300,394, 5,278,037, 4,006,025, 4,924,916, 4,294,917, 4,940,654, 4,950,586, 4,927,744, 5,279,931, 5,158,863, 5,135,844, 5,091,296, 5,089,380, 5,103,640, 4,990,431,4,970,139, 5,256,527, 5,015,564, 5,008,179, 4,957,857, and 2,870,012, British Pat. specifications Nos. 1,570,362 and 1,131,179 referenced above, the disclosures of which are hereby incorporated by reference, in the dispersing process of the filter dyes.

Additional surfactants or other water soluble polymers may be added after formation of the 1-aminopyridinium dispersion, before or after subsequent addition of the small particle dispersion to an aqueous coating medium for coating onto a photographic element support. The aqueous medium preferably contains other compounds such as stabilizers and dispersants, for example, additional anionic nonionic, zwitterionic, or cationic surfactants, and water soluble binders such as gelatin as is well known in the photographic element art. The aqueous coating medium may further contain other dispersion or emulsions of compounds useful in photography. Another technique for forming solid 1-aminopyridinium particles involves solvent precipitation. For example, a solution of the 1-aminopyridinium dye can be made in some water miscible, organic solvent, after which the solution of the 1-aminopyridinium dye can be added to an aqueous solution containing appropriate surfactants and polymers to cause precipitation.

Various techniques for forming a liquid dispersion of the 1-aminopyridinium dye, including oil-in-water emulsions, are well known by the skilled artisan. An oil-in-water dispersion of the 1-aminopyridinium dye may be prepared by dissolving the 1-aminopyridinium dye in an organic liquid, forming a premix with an aqueous phase containing dispersing aids such as water-soluble surfactants, polymers and film forming binders such as gelatin, and passing the premix through a mill until the desired particle size is obtained. The mill can be any high energy device such as a colloid mill, high pressure homogenizer, ultrasonic device, or the like. Preparation of conventional oil-in-water dispersions are well known in the art and are described in further detail, for example, in Jelly and Vittum U.S. Pat. No. 2,322,027. Alternatively, the filter dye can be loaded into a latex polymer, either during or after polymerization, and the latex can be dispersed in a binder. Additional disclosure of loaded latexes can be found in Milliken U.S. Pat. No. 3,418,127.

Combinations of bleachable filter or antihalation dyes can be used or one or more bleachable dyes can be used in combination with other non-bleachable dyes in the present invention to obtain a broader spectrum of absorption, if desired. For example, when the filter dye is used to provide antihalation properties or to permit room light loading, the filter dye should be selected to provide an absorption envelope that matches the sensitization envelope of the light sensitive layer(s) of the photographic element. Other filter dyes that can be used include, for example, the filter dyes disclosed in U.S. Pat. Nos. 2,538,008, 2,538,009, and 4,420,555, and UK Patents Nos. 695,873 and 760,739. It is preferred to use the filter dyes as solid particle dispersions as disclosed in U.S. Pat. Nos. 4,950,586, 4,948,718, 4,948,717, 4,940,654, 4,923,788, 4,900,653, 4,861,700, 4,857,446, 4,855,221, 5,213,956 and 5,213,957, and European Patent No. 430,186. The entire disclosures of the above patents are incorporated herein by reference.

For aqueous imaging systems, the binders used in the aqueous dispersion or coating composition should be transparent or translucent and include those materials which do not adversely affect the reaction which changes the dye from colored to colorless and which can withstand the processing temperatures employed. These polymers include, for example, proteins such as gelatin, gelatin derivatives, cellulose derivatives, polysaccharides such as dextran and the like, and synthetic polymeric substances such as water soluble polyvinyl compounds like poly(vinyl alcohol), poly (vinyl pyrrolidone), acrylamide polymers and the like. Other synthetic polymeric compounds which can be useful include dispersed vinyl compounds such as styrene butadiene rubbers in latex form. Effective polymers include high molecular weight materials, polymers and resins which are compatible with the imaging materials of the element. Combinations of the described colloids and polymers can also be useful if desired.

The antihalation layer as described can be useful in a variety of photothermographic elements. Useful photothermographic elements include those which are designed to provide an image from photographic silver halide, such as color images. Photothermographic color elements which are designed for consumer film are especially useful with the antihalation materials according to the invention.

The described combination of the 1-aminopyridinium dye can be in any suitable location in the photothermographic element which provides the desired bleaching of the dye upon heating. When the invention is utilized as an antihalation layer of a photographic material coated on a transparent support (such as photographic film), the inventive layer can be coated on the same side or the opposite of the support as the radiation sensitive layers. When the invention is utilized as an antihalation layer of a photographic material coated on a reflective support (such as photographic paper), then the inventive layer must be coated on the same side of the support as the radiation sensitive layers. When the invention is utilized as a filter layer of a photographic material, the same requirements apply depending upon the type of support used.

In one embodiment of the invention, the dye is in association with a melt former or thermal solvent to promote the desired heat bleaching in the antihalation or filter component. The term "in association" as employed herein is intended to mean that the described materials are in a location with respect to each other which enables the desired processing and heat bleaching and provides a more useful developed image. The term is also employed herein to mean that the filter dye and the melt former are in a location with respect to each other which enables the desired change of the dye from colored to colorless upon heating as described. In general, the two components should be in the same layer, meaning there is no significant barrier or distance between them even if not uniformly dispersed together. Preferably, however, the filter dye and the melt former are uniformly inter-dispersed. Alternatively, however, a sufficient amount of melt former may transfer from an adjacent imaging layer before and during thermal processing.

A preferred embodiment of the invention is a photothermographic element comprising (a) a support having thereon (b) a photothermographic layer, and on the support or in the support (c) at least one antihalation dye compound represented by the formula (I), as described, wherein the dye becomes at least about 50, preferably at least 90% colorless within about 30 seconds upon heating to a temperature of at least about 120° C., as determined by standard testing described herein.

The antihalation or filter layer materials comprising the described dye can be present in a suitable transparent support . However, it is more preferred that an antihalation layer according to the invention should comprise binders which adhere suitably to the support or other layer of the phototheimographic element upon which the antihalation or filter layer is coated. Selection of optimum binders for adhesion purposes will depend upon such factors as the particular support, processing conditions, the particular photosensitive layer, and the like.

A visible image can be developed in a photothermographic element according to the invention within a short time after imagewise exposure merely by uniformly heating the photothermographic element to moderately elevated temperatures. For example, the photothermographic element can be heated, after imagewise exposure, to a temperature within the range which provides development of the latent image and also provides the necessary temperature to cause the antihalation or filter layer to change from colored to colorless. Heating is typically carried out until a desired image is developed and until the antihalation or filter layer is bleached to a desired degree. This heating time is typically a time within about 1 second to about 20 minutes, such as about 1 second to about 90 seconds.

A simple exemplary photothermographic element, showing one embodiment comprising filter and AHU layers and their placement in the element, can be represented as follows:

| |
|---|
| UV Overcoat |
| Blue Sensitive Layer |
| Yellow Filter Layer |
| Green Sensitive Layer |
| Magenta Filter Layer |
| Red Sensitive Layer |
| AHU Layer |
| Support |

As indicated above, the invention is especially useful in a dry photothermographic process (or "dry thermal process"). By a "dry thermal process" is meant herein a process involving, after imagewise exposure of the photographic element, development of the resulting latent image by the use of heat to raise the temperature of the photothermographic element or film to a temperature of at least about 80° C., preferably at least about 100° C., more preferably at about 120° C. to 180° C., in a dry process or an apparently dry process. By a "dry process" is meant without the external application of any aqueous solutions. By an "apparently dry process" is meant a process that, while involving the external application of at least some aqueous solutions, does not involve an amount more than the uniform saturation of the film with aqueous solution.

This dry thermal process typically involves heating the photothermographic element until a developed image is formed, such as within about 0.5 to about 60 seconds. By increasing or decreasing the thermal processing temperature a shorter or longer time of processing is useful. Heating means known in the photothermographic arts are useful for providing the desired processing temperature for the exposed photothermographic element. The heating means can, for example, be a simple hot plate, iron, roller, heated drum, microwave heater, heated air, vapor or the like. Thermal processing is preferably carried out under ambient conditions of pressure and humidity, for simplicity sake, although conditions outside of normal atmospheric pressure and humidity are also useful.

A dry thermal process for the development of a color photothermographic film for general use with respect to consumer cameras provides significant advantages in processing ease and convenience, since they are developed by the application of heat without wet processing solutions. Such film is especially amenable to development at kiosks or at home, with the use of essentially dry equipment. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

Preferably, during thermal development an internally located blocked developing agent, in reactive association with each of three light-sensitive units, becomes unblocked to form a developing agent, whereby the unblocked developing agent is imagewise oxidized on development. It is necessary that the components of the photographic combination be "in association" with each other in order to produce the desired image. The term "in association" herein means that in the photothermographic element, the photographic silver halide and the image-forming combination are in a location with respect to each other that enables the desired processing and forms a useful image. This may include the location of components in different layers.

Such phototheimographic elements are used in the field of microfilming, health imaging, graphic arts, consumer products, and the like. It is especially useful where the element is exposed to visible light, directly or indirectly, in the field of health or medical imaging involving phosphorescent light, the originating exposure may be X-ray, for example. A preferred use of the present invention is in consumer color photothermographic film.

A typical photothermnographic element will now be described. The support for the photothermographic element can be either reflective or transparent, which is usually preferred. When reflective, the support is white and can take the form of any conventional support currently employed in color print elements. When the support is transparent, it can be colorless or tinted and can take the form of any conventional support currently employed in color negative elements-e.g., a colorless or tinted transparent film support. Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure* I .

Photographic elements may also usefully include a magnetic recording material as described in *Research Disclosure*, Item 34390, November 1992, or a transparent magnetic recording layer. such as a layer containing magnetic particles on the underside of a transparent support as in U.S. Pat. Nos. 4,279,945, and 4,302,523.

In an example (one embodiment) of a color negative film construction, each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure* I, cited above, X. Dye image formers and modifiers, B. Image-dye-forming couplers. The photographic elements may further contain other image-modifying compounds such as "Development Inhibitor-Releasing" compounds (DIR's). Useful additional DLR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269, 4,959,299; 4,966,835; 4,985,336 as well as in patent publications GB 1,560,240; GB 2,007,662, GB 2,032,914; GB 2,099,167; DE 2,842,063, DE 2,937,127; DE 3,636,824; DE 3,644,416 as well as the following European Pat. Publications: 272,573; 335,319; 336,411; 346,899; 362,870; 365, 252; 365,346; 373,382; 376,212; 377,463; 378,236; 384, 670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the photothermographic element is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptances according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes. may be desirable in the slower emulsions of the subdivided layer, unit to account for on-peak shielding and broadening of the underlying layer spectral sensitivity.

The photothermnogiaphic element may have inter-layers that are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate a reducing agent capable of reacting with oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

A photothermographic element may comprise a surface overcoat SOC which is a hydrophilic colloid layer that is provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The photothermographic elements of the present invention are preferably of type B as disclosed in *Research Disclosure* I. Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350, 4,264,725 and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663. Preferred examples of organic silver donors include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotiiazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. The emulsion layers also typically include one or more antifoggants or stabilizers, which can take any conventional form, as illustrated by section VII. Antifoggants and stabilizers.

The silver halide grains to be used in a photothermographic element may be prepared according to methods known in the art, such as those described in *Research Disclosure* I, cited above, and James, The Theory of the Photographic Process. These include methods such as, ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. In the course of grain precipitation one or more dopants (grain occlusions other than silver and halide) can be introduced to modify grain properties.

In a photothermographic element, the silver halide is typically provided in the form of an emulsion, including a vehicle for coating the emulsion as a layer of the element. Useful vehicles include both naturally occurring substances such as proteins, protein derivatives, cellulose derivatives (e.g., cellulose esters, ethers, and both anionically and cationically substituted cellulosics), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 $g/m^2$ of silver. Silver quantities of less than 7 $g/m^2$ are preferred, and silver quantities of less than 5 $g/m^2$ are even more preferred. The lower quantities of silver improve the optics of the elements, thus enabling the production of sharper pictures using the elements.

Because in one embodiment of the invention only silver development is required, color developers (p-phenylene diamines or p-aminophenolics) are not obligatory. Other developers that are capable of forming a silver image may also be used, without regard to their ability to form a colored dye. Such developers include, in addition to p-phenylene diamine developers and substituted p-aminophenols (3,5-dichloroaminophenol and 3,5-dibromoaminophenol are particularly preferred choices) but also p-sulfonamidophenols, ascorbic acid, low valent metal compounds, particularly those containing Fe(II), Cu(I), Co(II), Mn(II), V(II), or Ti(III), hydrazine derivatives, hydroxylamine derivatives, phenidones. For incorporated developers, thermally unblocking blocked developers are preferred.

In some cases, a development activator, also known as an alkali-release agent, base-release agent or an activator precursor can be useful in the described photothermographic element of the invention. A development activator, as described herein, is intended to mean an agent or a compound which aids the developing agent at processing temperatures to develop a latent image in the imaging material. Useful development activators or activator precursors are described, for example, in Belgian Pat. No. 709, 967 published Feb. 29, 1968, and Research Disclosure, Volume 155, Mar. 1977, Item 15567, published by Industrial Opportunities Ltd., Homewell, Havant, Hampshire, PO9 1EF, UK. Examples of useful activator precursors include guanidinium compounds such as guanidinium trichloroacetate, diguanidinium glutarate, succinate, malonate and the like, quaternary ammonium malonates; amino acids, such as 6-aminocaproic acid and glycine; and 2-carboxycarboxamide activator precursors.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning, and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND, U.S. application Ser. No. 09/475,691, filed Dec. 30, 1999, IMAGING ELEMENT CONTAINING A BLOCKED PHOTOGRAPHICALLY USEFUL COMPOUND, U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND, and U.S. application Ser. No. 09/476,233, filed Dec. 30, 1999, PHOTOGRAPHIC OR photothermographic ELEMENT CONTAINING A BLOCKED PHOTOGRAPHICALLY USEFUL COMPOUND.

In one embodiment of the invention, the blocked developer is preferably incorporated in one or more of the imaging layers of the imaging element. The amount of blocked developer used is preferably 0.01 to 5 $g/m^2$, more preferably 0.1 to 2 $g/m^2$ and most preferably 0.3 to 2 $g/m^2$ in each layer to which it is added. These may be color forming or non-color forming layers of the element. The blocked developer can be contained in a separate element that is contacted to the photographic element during processing.

After image-wise exposure of the imaging element, the blocked developer can be activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure* I"). All sections referred to herein are sections of *Research Disclosure* I, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

A reducing agent may be included in the photothermographic element. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid, an combination of polyhydroxybenzene and hydroxylaamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid, a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane, a combination of bis-o-naphthol and a 1,3-dihydroxybenzene derivative, (e. g., 2,4-dihydroxybenzophenone or 2,4-dihydroxyacetophenone); 5-pyrazolones such as 3-methyl-1- phenyl-5-pyrazolone, reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1, 3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane, 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g.,. 1- ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

It is useful to include a melt-forming compound or melt former (also sometimes referred to as a "thermal solvent") in a photothermographic element, such as in the imaging layers and in the antihalation layer or filter layer, as described. Combinations of melt-forming compounds or melt-formers can also be useful if desired. The term "melt-forming compound" or "melt former" as employed herein is intended to mean a compound which upon heating to the described processing temperature provides an improved reaction medium, typically a molten medium, wherein the described reaction combination can provide a better image. The exact nature of the reaction medium at processing temperatures described is not fully understood; however, it is believed that at reaction temperatures a melt occurs which permits the reaction components to better interact. Useful melt-forming compounds are typically separate components from the reaction combination, although the reaction combination can enter into the melt formation. Typically useful melt-forming compounds are amides, imides, cyclic ureas and triazoles which are compatible with other of the components of the materials of the invention. Useful melt-forming compounds or melt formers are described, for example, in Research Disclosure, Vol. 150, October 1976, Item 15049 of LaRossa and Boettcher, published by Industrial Opportunities Ltd., Homewell, Havant, Hampshire, PO9 1EF, UK. As described, the antihalation or filter layers of the invention can comprise a melt-forming compound if desired. A preferred melt-former is salicylanilide and similar compounds. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonarnide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

A range of concentration of melt-forming compound or melt-forming compound combination is useful in the heat developable photographic materials described. The optimum concentration of melt-forming compound will depend upon such factors as the particular imaging material, desired image, processing conditions and the like.

The photothermographic elements according to the invention can contain an image toner or toning agent in order to provide a more neutral or black tone image upon processing. The optimum image toner or toning agent will depend upon such factors as the particular imaging material, the desired image, particular processing conditions and the like. In some cases certain image toning agents or toners provide much better results with certain imaging materials than with others. Combinations of toning agents or toners can be useful if desired. The optimum concentration of toning agent or toning agent combination will depend upon such factors as the particular imaging material, processing conditions, desired image and the like.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

In one embodiment, a photothermographic elements can be scanned prior to any removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443. Method for the scanning of such films are also disclosed in commonly assigned U.S. Ser. Nos. 60/211,364 and 60/211,061 hereby incorporated by reference in their entirety.

For example, it is possible to scan the photographic element successively within the blue, green, and red regions of the spectrum or to incorporate blue, green, and red light within a single scanning beam that is divided and passed through blue, green, and red filters to form separate scanning beams for each color record. If other colors are imagewise present in the element, then appropriately colored light beams are employed. A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in U.S. Ser. No. 09/592,816 titled AN IMAGE PROCESSING AND MANIPULATION SYSTEM to Richard P. Szajewski, Alan Sowinski and John Buhr. Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722, Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713, Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346, Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

For illustrative purposes, a non-exhaustive list of photothermographic film processes involving a common dry heat development step are as follows:

1. heat development=>scan=>stabilize (for example, with a laminate)=>scan=>obtain returnable archival film.
2. heat development=>fix bath=>waterwash=>dry=>scan=>obtain returnable archival film
3. heat development=>scan=>blix bath=>dry=>scan=>recycle all or part of the silver in film
4. heat development=>bleach laminate=>fix laminate=>scan=>(recycle all or part of the silver in film)
5. heat development=>bleach=>wash=>fix=>wash=>dry=>relatively slow, high quality scan In a preferred embodiment of a photothermographic film according to the present invention, the processing time to first image (either hard or soft display for customer/consumer viewing), including (i) thermal development of a film, (ii) scanning, and (iii) the formation of the positive image from the developed film, is suitably less than 5 minutes, preferably less than 3.5 minutes, more preferably less than 2 minutes, most preferably less than about 1 minute. In one embodiment, such film might be amenable to development at kiosks, with the use of simple dry or apparently dry equipment. Thus, it is envisioned that a consumer could bring an imagewise exposed photographic film, for development and printing, to a kiosk located at any one of a number of diverse locations, optionally independent from a wet-development lab, where the film could be developed and printed without any manipulation by third-party technicians. A photothermographic color film, in which a silver-halide-containing color photographic element after imagewise exposure can be developed merely by the external application of heat and/or relatively small amounts of alkaline or acidic water, but which same film is also amenable to development in an automated kiosk, preferably not requiring third-party manipulation, would have significant advantages. Assuming the availability and accessibility of such kiosks, such photothermographic films could potentially be developed at any time of day, "on demand," in a matter minutes, without requiring the participation of third-party processors, multiple-tank equipment and the like. Optional, such photographic processing could potentially be done on an "as needed" basis, even one roll at a time, without necessitating the high-volume processing that would justify, in a commercial setting, equipment capable of high-throughput. Color development and subsequent scanning of such a film could readily occur on an individual consumer basis, with the option of generating a display element corresponding to the developed color image. By kiosk is meant an automated free-standing machine, self-contained and (in exchange for certain payments) capable of developing a roll of imagewise exposed film on a roll-by-roll basis, without the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably 3 cubic meters or less in dimension, and hence commercially transportable to diverse locations. Such kiosks may optionally comprise a heater for color development, a scanner for digitally recording the color image, and a device for transferring the color image to a display element.

The following examples are presented to illustrate the practice of this invention, but are not meant to limit it in any way. All percentages are by weight unless otherwise indicated.

EXAMPLE 1

Dyes DC-1 to DC-3 were evaluated in a single layer coating. This dye class was disclosed in prior arts (references: U.S. Pat. Nos. 3,627,527 and 4,594,312). The dyes were dissolved in methanol and added to a coating melt preparation to yield the coverages indicated in Table 1-1. The salicylanilide was a ball-milled dispersion of solid particles. The coating melts were coated onto polyethylene terephthalate support.

TABLE 1-1

| component | laydown, g/m$^2$ |
|---|---|
| dye | 0.30 |
| salicylanilide | 1.08 |
| gelatin | 4.31 |

| dye | structure |
|---|---|
| DC-1 | 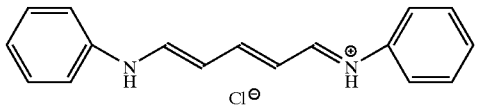 |
| DC-2 | 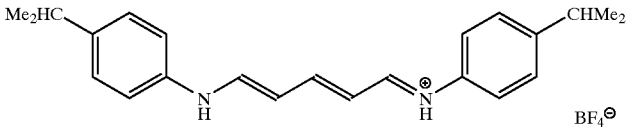 |
| DC-3 | 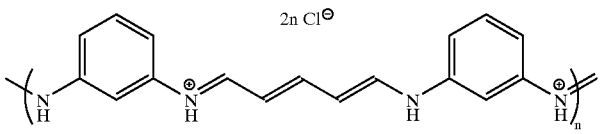 |

The coatings were evaluated for thermal bleaching by placing the dried coatings onto a heated 140° C. platen for 20 seconds. In addition, the coatings were evaluated for incubation (raw stock keeping, or RSK) by sealing the coatings into Mylar bags and placing them into a heated oven at 50° C. for 1 week. The Status M density (see table for filter used) of the coatings was recorded before and after the above tests. The results are listed in Table 1-2.

TABLE 1-2

| coating | dye | filter used | density before tests | density after 20"/140° C. | density after RSK |
|---|---|---|---|---|---|
| C-1-1 | DC-1 | blue | 1.34 | 0.29 | 0.10 |
| C-1-2 | DC-2 | blue | 0.93 | 0.12 | 0.11 |
| C-1-3 | DC-3 | green | 0.63 | 0.14 | 0.29 |

The data in the above table show conclusively that although the coatings bleached effectively at the process temperature, they also showed unacceptable raw stock keeping characteristics to be useful.

EXAMPLE 2

Dyes DC-4 to DC-10 and DI-1are described in Table 2-1. All of the comparative dyes are cationic, therefore they have negative counter ions associated with them. The inventive example DI-1is zwittterionic in nature, where the negative charge is a part of the dye molecule. In the table below, the arrow designates the coupling position of the fragment to the basic structure.

TABLE 2-1

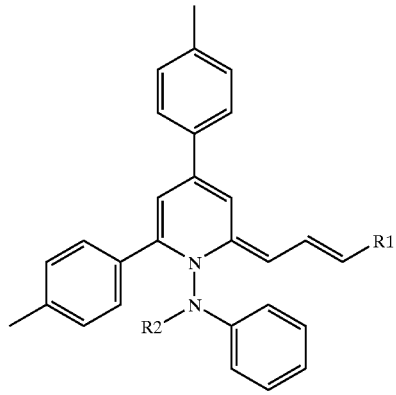

| dye | counterion | R1 | R2 |
|---|---|---|---|
| DC-4 | $BF_4^-$ | 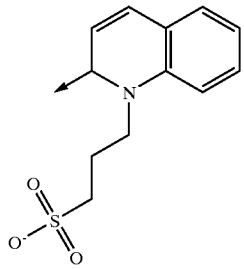 | —$CH_3$ |
| DC-5 | $BF_4^-$ | 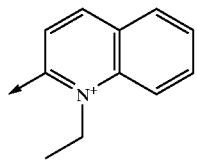 | —$CH_3$ |

TABLE 2-1-continued

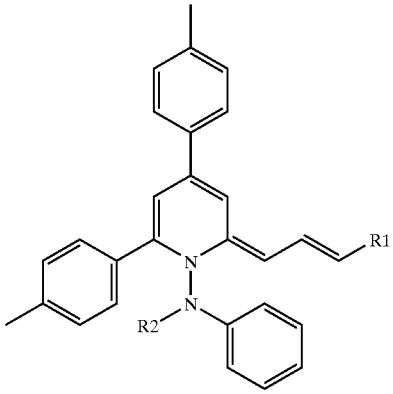

| dye | counterion | R1 | R2 |
|---|---|---|---|
| DC-6 | $BF_4^-$ | 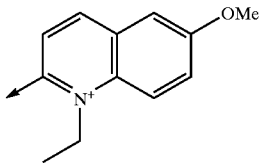  | —$CH_3$ |
| DC-7 | $BF_4^-$ | 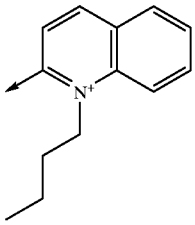  | —$CH_3$ |
| DC-8 | $BF_4^-$ | 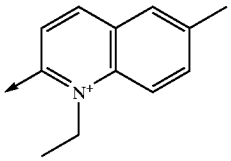  | —$COCH_3$ |
| DC-9 | $I^-$ | 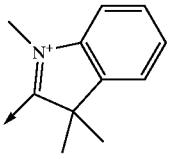  | —$CH_3$ |
| DC-10 | $ClO_4^-$ | 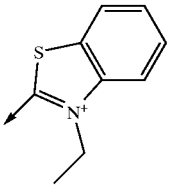  | —$COCH_3$ |

TABLE 2-1-continued

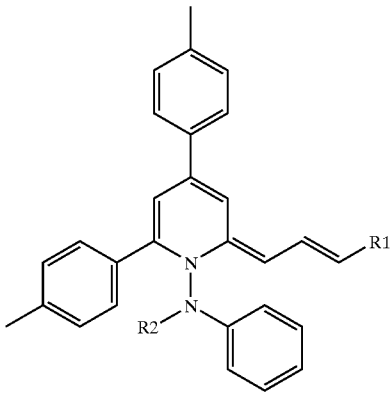

| dye | counterion | R1 | R2 |
|---|---|---|---|
| DI-1 | none | 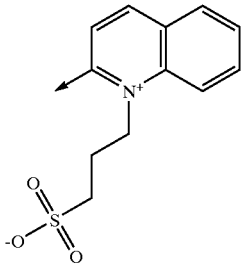  | —$CH_3$ |

All of the dyes in Table 2-1 were evaluated in a single layer coating. The dyes were ball-milled with polyvinyl pyrrolidone surfactant and added to a coating melt preparation.

EXAMPLE 3

All of the dyes of the previous example were evaluated in a single layer coating containing melt former. The dyes were ball-milled and added to a coating melt preparation to yield the coverages indicated in Table 3-1. The salicylanilide was a ball-milled dispersion of solid particles. The coating melts were coated onto polyethylene terephthalate support.

TABLE 3-1

| component | laydown, $g/m^2$ |
|---|---|
| dye | 0.30 |
| salicylanilide | 1.08 |
| gelatin | 4.31 |

The coatings were evaluated for thermal bleaching by placing the dried coatings onto a heated 160° C. platen for 10 seconds. In addition, the coatings were evaluated for incubation (raw stock keeping, or RSK) by sealing the coatings into Mylar bags and placing them into a heated oven at 50° C. for 1 week. The Status M density (see table for filter used) of the coatings was recorded before and after the above tests. The results are listed in Table 3-2.

TABLE 3-2

| coating | dye | filter used | before tests | after process | after RSK |
|---|---|---|---|---|---|
| C-3-1 | DC-4 | red | 0.75 | 0.07 | 0.24 |
| C-3-2 | DC-5 | red | 0.51 | 0.07 | 0.20 |
| C-3-3 | DC-6 | red | 0.87 | 0.07 | 0.28 |
| C-3-4 | DC-7 | red | 0.64 | 0.09 | 0.16 |
| C-3-5 | DC-8 | red | 0.41 | 0.12 | 0.26 |
| C-3-6 | DC-9 | green | 0.47 | 0.39 | 0.33 |
| C-3-7 | DC-10 | green | 0.56 | 0.30 | 0.50 |
| I-3-1 | DI-1 | red | 0.81 | 0.10 | 0.42 |

In this format, many of the dyes bleached very well. Of the dyes that bleached to an acceptable amount (greater than 75% bleaching after thermal processing for 10 seconds at 160° C.), the inventive material had the lowest percentage loss during the RSK, and was therefore the most useful. RSK evaluations were not important for the materials with less than acceptable thermal bleaching. The calculated percent bleaching and incubation loss data are reported in Table 3-3.

TABLE 3-3

| coating | dye | % bleaching after process | % loss after RSK |
|---|---|---|---|
| C-3-1 | DC-4 | 90.7 | 68.0 |
| C-3-2 | DC-5 | 86.3 | 60.8 |
| C-3-3 | DC-6 | 92.0 | 67.8 |
| C-3-4 | DC-7 | 85.9 | 75.0 |
| C-3-5 | DC-8 | 70.7 | — |
| C-3-6 | DC-9 | 17.0 | — |
| C-3-7 | DC-10 | 46.4 | — |
| I-3-1 | DI-1 | 87.7 | 48.2 |

The inventive dye exhibited superior performance to the comparative dyes.

EXAMPLE 4

Dyes DC-6 and DI-1 were coated with varying levels of salicylanilide melt former. The dyes were ball-milled and added to a coating melt preparation. The salicylanilide was a ball-milled dispersion of solid particles and added to yield the coverages indicated in Table 4-1. The dye and gelatin laydowns were held constant at 0.30 and 4.31 g/m$^2$ respectively. The coating melts were coated onto polyethylene terephthalate support.

TABLE 4-1

| coating | dye | melt former, g/m$^2$ |
|---|---|---|
| C-4-1 | DC-6 | 0.054 |
| C-4-2 | DC-6 | 0.108 |
| C-4-3 | DC-6 | 0.161 |
| I-4-1 | DI-1 | 0.054 |
| I-4-2 | DI-1 | 0.108 |
| I-4-3 | DI-1 | 0.161 |

The coatings were evaluated for thermal bleaching by placing the dried coatings onto a heated 160° C. platen 10 seconds. In addition, the coatings were evaluated for incubation (raw stock keeping, or RSK) by sealings the coatings into Mylar bags and placing them into a heated oven at 50° C. for 1 week. The Status M red density of the coatings was recorded before and after the above tests. The results are listed in Table 4-2.

TABLE 4-2

| coating | dye | before/after 10"/160° C. | percent bleaching | before/after RSK | percent loss after RSK |
|---|---|---|---|---|---|
| C-4-1 | DC-6 | 0.58/0.07 | 87.9 | 0.58/0.47 | 19.0 |
| C-4-2 | DC-6 | 0.65/0.08 | 87.7 | 0.75/0.47 | 37.3 |
| C-4-3 | DC-6 | 0.73/0.08 | 89.0 | 0.75/0.57 | 24.0 |
| I-4-1 | DI-1 | 0.84/0.20 | 76.2 | 0.76/0.66 | 13.2 |
| I-4-2 | DI-1 | 0.68/0.13 | 80.9 | 0.73/0.54 | 26.0 |
| I-4-3 | DI-1 | 0.81/0.13 | 84.0 | 0.87/0.71 | 18.4 |

All the coatings bleached well during thermal processing for 10 seconds at 160° C. The inventive dye suffered the least amount of loss during the critical RSK—while the loss for the inventive dye (DI-1) was in the range of 13.2 to 26.0%, the comparative dye (DC-6) had suffered a large loss in the range of 19.0% to 37.1%. The inventive dye is more useful than the comparative dye.

EXAMPLE 5

Two additional dyes were synthesized for evaluation. The structure for dyes DI-2 and DI-3 are below. The dyes were ball-milled and added to a coating melt preparation to yield the coverage indicated in Table 5-1. The coatings melts were onto polyethylene terephthalate support.

| dye | structure |
|---|---|
| DI-2 | 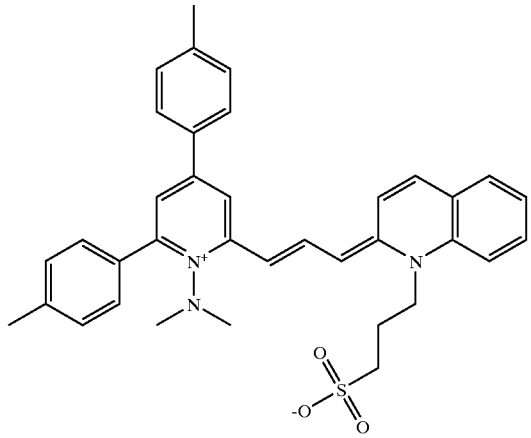 |
| DI-3 | 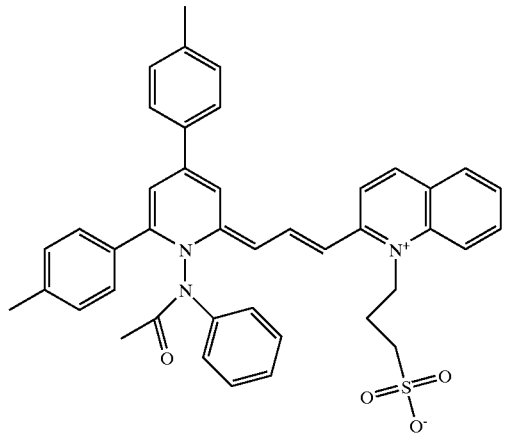 |

TABLE 5-1

| component | coating I-5-1 laydown, g/m$^2$ | coating I-5-2 laydown, g/m$^2$ |
|---|---|---|
| dye | 0.30 | 0.30 |
| salicylanilide | 0.21 | 1.08 |
| gelatin | 4.31 | 4.31 |

The coatings were evaluated for thermal bleaching by placing the dried coatings onto a heated 180° C. platen for 10 seconds. The Status M red density of the coatings was recorded before and after the thermal process. The results are listed in Table5-2.

TABLE 5-2

| Coating | dye | before process | after process | % bleaching |
|---|---|---|---|---|
| I-5-1 | DI-2 | 0.36 | 0.07 | 80.6 |
| I-5-2 | DI-3 | 0.44 | 0.08 | 81.8 |

The data in the table clearly show good bleaching performance for the inventive dyes.

EXAMPLE 6

The inventive dye DI-1 was evaluated in a multilayer coating. The following components were used in this example.

Silver Salt Dispersion SS-1

A stirred reaction vessel was charged with 480 g of lime processed gelatin and 6.61 of distilled water. A solution containing 0.7 M silver nitrate was prepared (Solution A). A solution containing 0.7 M benzotriazole and 0.7 M NaOH was prepared (Solution B). The mixture in the reaction vessel was adjusted to a pAg of 7.25 and a pH of 8.00 by addition of Solution B, nitric acid, and sodium hydroxide as needed.

Solution A was added with vigorous mixing to the kettle at 38 cc/minute, and the pAg was maintained at 7.25 by a simultaneous addition of solution B. This process was continued until the quanity of silver nitrate added to the vessel was 3.54 M, at which point the flows were stopped and the mixture was concentrated by ultrafiltration. The resulting silver salt dispersion contained fine particles of silver benzotriazole.

Silver Salt Dispersion SS-2

A stirred reaction vessel was charged with 480 g of lime processed gelatin and 5.61 of distilled water. A solution containing 0.7 M silver nitrate was prepared (Solution A). A solution containing 0.7 M 1-phenyl-5-mercaptotetrazole and 0.7 M NaOH was also prepared (Solution B). The mixture in the reaction vessel was adjusted to a pAg of 7.25 and a pH of 8.00 by additions of Solution B, nitric acid, and sodium hydroxide as needed.

Solution A was added to the kettle at 19.6 cc/minute, and the pAg was maintained at 7.25 by a simultaneous addition of solution B. This process was continued until the 3.54 moles of silver nitrate had been added to the vesses, at which point the flows were stopped and mixture was concentrated by ultrafiltration. The resulting silver salt dispersion contained fine particles of the silver salt of 1-phenyl-5-mercaptotrazole.

Melt Former MF-1 Dispersion

A dispersion of salicylanilide was prepared by the method of ball milling. To a total 20 g sample was added 3.0 gm salicylanilide solid, 0.20 g polyvinyl pyrrolidone, 0.20 g TRITON X-200 surfactant, 1.0 g gelatin, 15.6 g distilled water, and 20 ml of zirconia beads. The slurry was ball milled for 48 hours. Following milling, the zirconia beads were removed by filtration. The slurry was refrigerated prior to use.

Developer D-1 Dispersion

A slurry was milled in water containing developer D-1 and OLIN 10G as a surfactant. The OLIN 10 G was added at a level of 10% by weight of the D-1. To the resulting slurry was added water and dry gelatin in order to bring the final concentrations to 13% D-1 and 4% gelatin. The gelatin was allowed to swell by mixing the components at 15° C. for 90 minutes. After this swelling process, the gelatin was dissolved by bringing the mixture to 40° C. for 10 minutes, followed by cooling to the chill set the dispersion.

D-1:

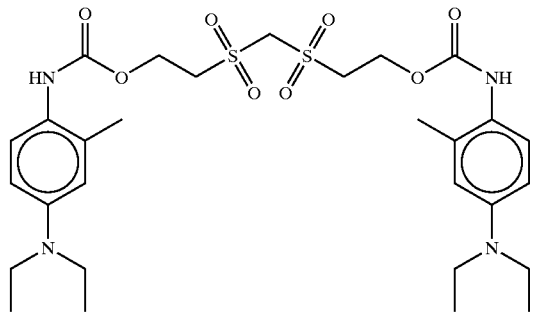

Coupler Dispersion MC-1

A coupler dispersion was prepared by conventional means containing coupler M-1 at 5.5% and gelatin at 8%. The dispersion contained coupler solvents tricresyl phosphate and CS-1 at weight ratios of 0.8 and 0.2 relative to the coupler M-1, respectively.

M-1:

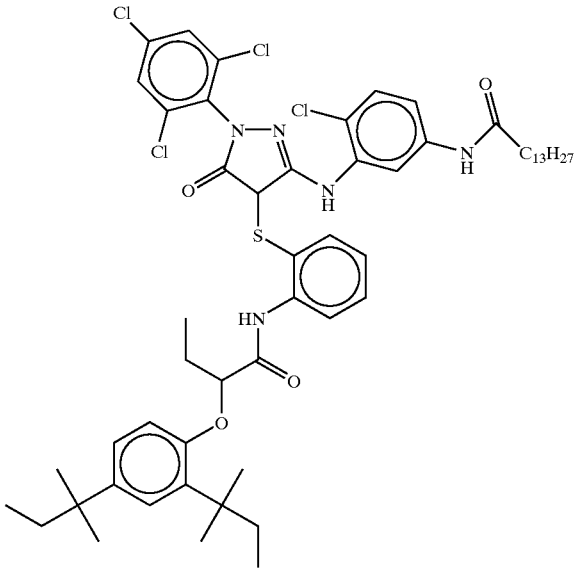

-continued

CS-1

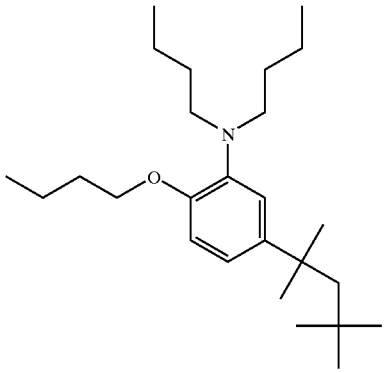

Coupler Dispersion CC-1

An oil based coupler dispersion was prepared by conventional means containing coupler C-1 at 6% and gelatin 6%. Coupler solvent tricesyl phosphate was included at a weight ratio of 1.1% relative to coupler C-1.

C-1:

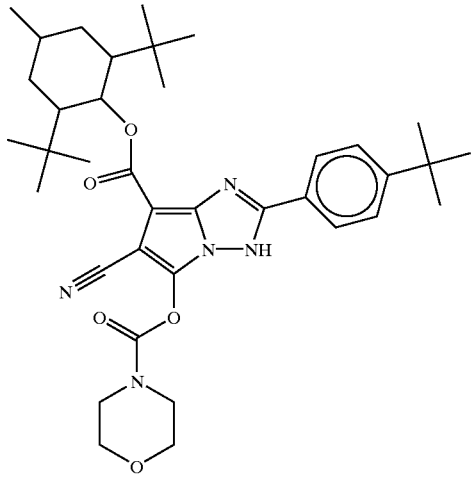

Coupler Dispersion YC-1

An oil based coupler dispersion was prepared by conventional means containing coupler Y-1 at 6% and gelatin at 6%. Coupler solvent CS-2 was included at a weight ratio of 1:1% relative to coupler Y-1.

Y-1

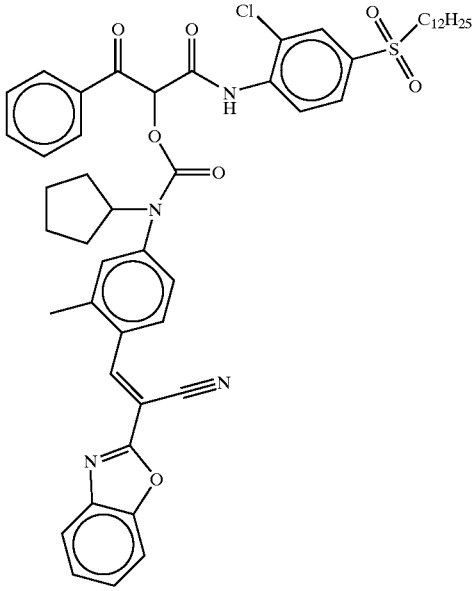

CS-2

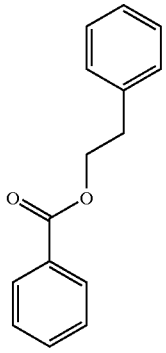

-continued
Dye-1
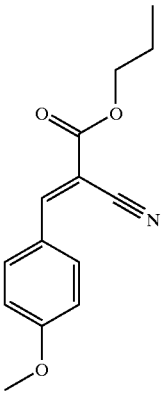
(UV)
Dye-2
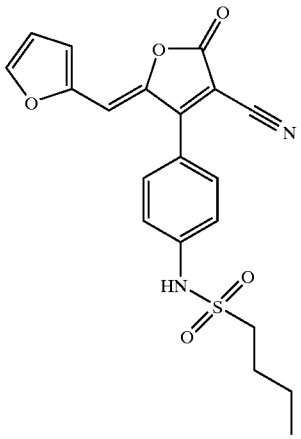
Dye-3
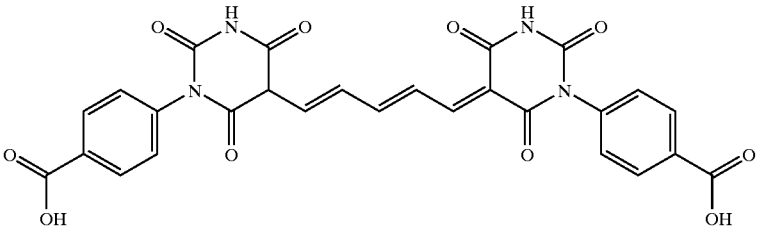
HAR-1
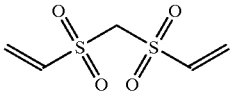
CA-1
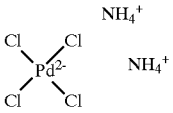
CA-2
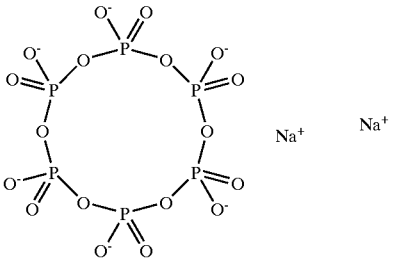
CA-3
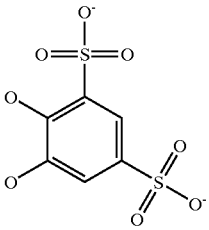
CA-4
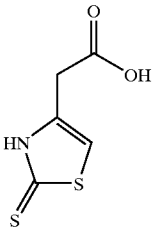
CA-5
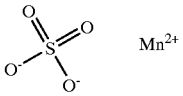
AF-1
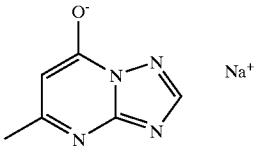

The multilayer structure as shown in Table 6-1 was coated on a polyethylene terephthalate support. The coating was accomplished using an extrusion hopper that applied each layer in a sequential process.

TABLE 6-1

| Overcoat | | |
|---|---|---|
| Gelatin | 1.2960 | g/m$^2$ |
| Silicone Polymer DC-200 (Dow Coming) | 0.0389 | |
| Matte Beads | 0.1134 | |
| Dye-1 (UV) | 0.0972 | |
| FC-135 Fluorinated Surfactant | 0.1058 | |
| HAR-1 | 0.5108 | |
| **Fast Yellow** | | |
| Gelatin | 1.9980 | g/m$^2$ |
| SS-1 | 0.1512 | |
| SS-2 | 0.1512 | |
| YC-1 | 0.2160 | |
| MF-1 | 0.5184 | |
| D-1 | 0.5184 | |
| Yellow Sens. Emulsion: 3.5 × 0.128 micron | 0.4860 | |
| AF-1 | 0.0079 | |
| **Slow Yellow** | | |
| Gelatin | 2.7540 | g/m$^2$ |
| SS-1 | 0.2376 | |
| SS-2 | 0.2376 | |
| YC-1 | 0.3780 | |
| MF-1 | 0.5832 | |
| D-1 | 0.5832 | |
| Yellow Sens. Emulsion: 1.5 × 0.129 micron | 0.2160 | |
| Yellow Sens. Emulsion: 0.6 × 0.139 micron | 0.0756 | |
| Yellow Sens. Emulsion: 0.5 × 0.13 micron | 0.1512 | |
| Yellow Sens. Emulsion: 0.55 × 0.08 micron | 0.1512 | |
| AF-1 | 0.0096 | |
| **Interlayer 2** | | |
| Gelatin | 1.0800 | g/m$^2$ |
| CA-1 | 0.0022 | |
| Dye-2 | 0.0864 | |
| **Fast Magenta** | | |
| Gelatin | 1.7820 | g/m$^2$ |
| SS-1 | 0.1512 | |
| SS-2 | 0.1512 | |
| MC-1 | 0.2160 | |
| MF-1 | 0.2160 | |
| D-1 | 0.2160 | |
| Magenta Sens. Emulsion: 2.1 × 0.131 micron | 0.4860 | |
| AF-1 | 0.0079 | |
| **Mid Magenta** | | |
| Gelatin | 1.1340 | g/m$^2$ |
| SS-1 | 0.1188 | |
| SS-2 | 0.1188 | |
| MC-1 | 0.1944 | |
| MF-1 | 0.1188 | |
| D-1 | 0.1188 | |
| Magenta Sens. Emulsion: 1.37 × 0.119 micron | 0.0648 | |
| Magenta Sens. Emulsion: 0.6 × 0.139micron | 0.1728 | |
| AF-1 | 0.0039 | |
| **Slow Magenta** | | |
| Gelatin | 1.1340 | g/m$^2$ |
| SS-1 | 0.1188 | |
| SS-2 | 0.1188 | |
| MC-1 | 0.1944 | |
| MF-1 | 0.1188 | |
| D-1 | 0.1188 | |
| Magenta Sens. Emulsion: 0.5 × 0.13 micron | 0.1080 | |

TABLE 6-1-continued

| | | |
|---|---|---|
| Magenta Sens. Emulsion: 0.55 × 0.08 micron | 0.1404 | |
| AF-1 | 0.0049 | |
| **Interlayer 1** | | |
| Gelatin | 1.0800 | g/m$^2$ |
| CA-1 | 0.0022 | |
| **Fast Cyan** | | |
| Gelatin | 2.2140 | g/m$^2$ |
| SS-1 | 0.1512 | |
| SS-2 | 0.1512 | |
| CC-1 | 0.2592 | |
| MF-1 | 0.5184 | |
| D-1 | 0.5184 | |
| Cyan Sens. Emulsion: 2.3 × 0.13 micron | 0.4860 | |
| AF-1 | 0.0079 | |
| **Mid Cyan** | | |
| Gelatin | 1.7280 | g/m$^2$ |
| SS-1 | 0.1188 | |
| SS-2 | 0.1188 | |
| CC-1 | 0.2322 | |
| MF-1 | 0.2916 | |
| D-1 | 0.2916 | |
| Cyan Sens. Emulsion: 1.37 × 0.119 micron | 0.1512 | |
| Cyan Sens. Emulsion: 06 × 0.139 micron | 0.1512 | |
| AF-1 | 0.0039 | |
| **Slow Cyan** | | |
| Gelatin | 1.7280 | g/m$^2$ |
| SS-1 | 0.1188 | |
| SS-2 | 0.1188 | |
| CC-1 | 0.2322 | |
| MF-1 | 0.2916 | |
| D-1 | 0.2916 | |
| Cyan Sens. Emulsion: 0.55 × 0.08 micron | 0.1512 | |
| Cyan Sens. Emulsion: 0.5 × 0.13 micron | 0.1512 | |
| AF-1 | 0.0049 | |
| **AHU-01 [01]** | | |
| Gelatin | 1.6200 | g/m$^2$ |
| CA-2 | 0.0076 | |
| CA-3 | 0.2700 | |
| CA-4 | 0.0005 | |
| CA-5 | 0.0008 | |
| AF-1 | 0.0022 | |

Three variations were made off of the above coating structure. Variations consisted of changing the AHU dye that was present in the AHU layer. For each of these variations, the Status M Red Dmin of the coating was measured for the unprocessed film, as well as a sample of the film processed at 140C for 18 seconds using a heated drum processor. Table 6-2 shows the results of these measurements.

TABLE 6-2

| coating | additional components to AHU | unprocessed red Dmin | processed red Dmin (140 C/18") |
|---|---|---|---|
| C-6-1 | None | 0.37 | 0.19 |
| C-6-2 | 0.043 g/m$^2$ Dye-3 | 0.74 | 0.66 |
| I-6-1 | 0.22 g/m$^2$ DI-1<br>0.11 g/m$^2$ MF-1 | 0.70 | 0.25 |

The data in Table 6-2 indicate that while the inventive DI-1 and the comparative Dye-3 were coated at levels that formed very similar amounts of density in the unprocessed film, there was significant bleaching of the inventive dye during the process of heating the multilayer coating.

The invention has been described in detail with particular reference to certain preferred embodiments thereof, but it will be understood that variations and modifications can be effected within the spirit and scope of the invention.

What is claimed is:

1. A color photothermographic element comprising a support having thereon at least three light-sensitive units which have their individual sensitivities in different wavelength regions and at least one light-absorbing layer comprising a zwitterionic 1-aminopyridinium dye having a methine linkage terminated by a substituted or unsubstituted heterocyclic nucleus, wherein a nitrogen atom in the heterocyclic nucleus is substituted with an anion-containing group, wherein the dye is in the form of a dispersion of solid particles having an average size of 0.01 to 5 microns and wherein said dye becomes at least about 50% colorless within about 5 minutes upon heating to a temperature of at least about 90° C.

2. The color phototheimographic element of claim 1 wherein each of the light-sensitive units comprises an aqueous emulsion comprising a hydrophilic binder.

3. The color photothermographic element of claim 2 wherein said light-sensitive silver-halide emulsion layer and said light-absorbing layer comprises a hydrophilic colloid.

4. The color photothermographic element of claim 3 wherein the hydrophilic colloid is a polymer is selected from the group consisting of gelatin, poly(vinyl alcohol), poly (vinyl pyrrolidone), and poly(amides), or derivatives thereof.

5. The color photothermographic element of claim 4 wherein the hydrophilic colloid is gelatin.

6. The color photothermographic element of claim 1 wherein each of the units comprise at least one light-sensitive silver-halide emulsion, a binder, dye-forming coupler, and a blocked developer.

7. The color photothermographic element of claim 1, wherein the dye is represented by the following structure:

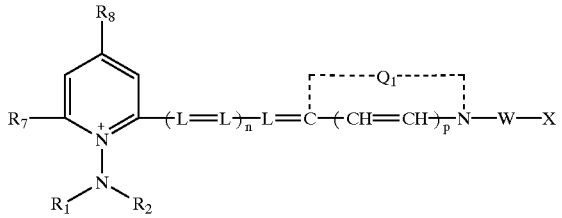

wherein:

$R_1$ and $R_2$ can independently be selected from the group consisting of:

(a) an alkyl group, (b) an acyl group, (c) an aryl group, (d) a heterocyclic nucleus containing five to six members in the nucleus, and (e) together form a five to six-membered heterocyclic nucleus, $Q_1$ represents the non-metallic atoms necessary to complete a saturated, unsaturated, or aromatic heterocyclic nucleus containing five to fifteen atoms in the heterocyclic ring, which nucleus can contain at least one additional heteroatom, and which heterocyclic nucleus can be substituted or unsubstituted by up to 5 independently selected substituents, W is a linking group selected from substituted or unsubstituted alkylene, alkoxyalkylene, alkoxycarbonylalkylene, aralkylene, alkenylene, allylene, and arylene group, X represents an anionic group selected from the group consisting of including a sulfate, phosphate, sulfonate, phosphonate and carboxyl groups;

n is one or two;

p represents the number of double bonds in the heterocylic ring between the N atom and the first methine linkage and is zero or one;

L represents a methine linkage having the formula

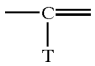

wherein T can be hydrogen, halogen, carboxamide, lower alkyl of one to four carbon atoms or aryl, $R_7$ and $R_8$ each can be a hydrogen atom, an alkyl group, or an aryl group.

8. The color photothermographic element of claim 7 wherein X is a sulfonate group $—SO_3^-$.

9. The color photothermographic element of claim 7 wherein the dye has the following structure:

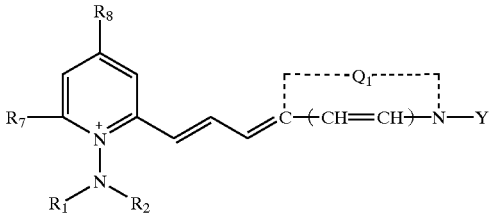

wherein $Q_1$, $R_1$, $R_2$, $R_7$ and $R_8$ are as defined and Y is a sulfoalkyl, carboxyalkyl, or phosphoalkyl group, in which Y has 1 to 10 carbon atoms.

10. The color photographic element of claim 9 wherein the dye is a 1-aminopyridinium compound having the following structure:

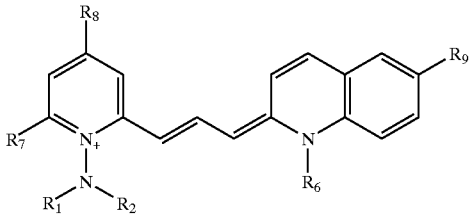

wherein $R_1$, $R_2$, $R_7$, $R_8$, and Y are as defined above and $R_9$ is hydrogen, substituted or unsubstituted alkyl, substituted or unsubstituted alkoxy, substituted or unsubstituted aryl or alkylaryl, nitro, hydroxy, or halogen.

11. The color photographic element of claim 9 wherein the dye is a 1-aminopyridinium compound having the following structure:

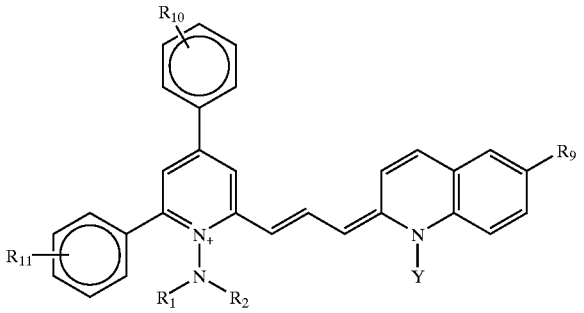

wherein $R_1$, $R_2$, $R_7$, $R_8$, $R_9$ and Y are as defined above, and $R_{10}$ and $R_{11}$ are independently selected from the $R_9$ groups mentioned above.

12. The color photothermographic element of claim 1 wherein the dye is in the form of particles having an average diameter of 0.01 to 5 microns.

13. The color photothermographic element of claim 1 wherein the the light-absorbing layer and the imaging layer are both at least 5 percent by weight water.

14. A color photothermographic element comprising (a) a support, having thereon (b) at least three light-sensitive imaging layers which have their individual sensitivities in different wavelength regions and (c) an antihalation layer, below the light-sensitive imaging layers, comprising (i) at least one zwitterionic 1-aminopyridinium dye having a methine linkage terminated by a substituted or unsubstituted heterocyclic nucleus, wherein a nitrogen atom in the heterocyclic nucleus is substituted with an anion-containing group, wherein the dye is in the form of a dispersion of solid particles having an average size of 0.01 to 5 microns and wherein said dye becomes at least about 50% colorless within about 5 minutes upon heating to a temperature of at least about 90° C.

15. The photothermographic element of claim 14, wherein said imaging layers further comprise a non-light-sensitive organic, silver salt oxidizing agent, further in combination with an incorporated developing agent.

16. A photothermographic element as in claim 14 wherein said antihalation layer is between said support and said imaging layers which imaging layers comprise photosensitive silver halide.

17. A photothermographic element as in claim 14 wherein said antihalation layer is on the side of said support opposite the side containing said imaging layers.

18. A color photothermographic process for preparing visible color photographic images comprising the steps of:

(a) providing a photothermographic film comprising a support having coated thereon (i) at least three light-sensitive imaging layers which have their individual sensitivities in different wavelength regions and which comprise photosensitive silver halide, a water-insoluble organic silver salt as an oxidizing agent, and a reducing agent for silver ion, and (ii) a light-absorbing layer comprising an antihalation dye that is a zwitterionic 1-aminopyridinium compound having a methine linkage terminated by a substituted or unsubstituted heterocyclic nucleus, wherein a nitrogen atom in the heterocyclic nucleus is substituted with an anion-containing group, (b) thermally developing the film without any externally applied developing agent, comprising heating said film to a temperature greater than 100° C. for at least 0.5 seconds, such that an internally located blocked developing agent in reactive association with each of said three light-sensitive layers becomes unblocked to form a developing agent, whereby the unblocked developing agent forms dyes by reacting with dye-forming couplers to form a color image; and wherein said antihalation dye becomes at least about 50% colorless; and (c) scanning the color image to provide a digital electronic record capable of generating a positive color image in a display means.

19. The photothermographic method according to claim 18 wherein thermal development is conducted under substantially dry process conditions without the application of aqueous solutions.

20. The photothermographic process of claim 18 wherein said light-absorbing, during thermal development, becomes substantially colorless within 2 minutes upon heating to a temperature of at least 90° C.

21. A method according to claim 18, wherein thermal development comprises treating said imagewise exposed element at a temperature between about 100° C. and about 180° C. for a time ranging from about 0.5 to about 60 seconds.

22. A method according to claim 18 wherein image formation comprises the step of scanning an imagewise exposed and developed imaging element to form a first electronic image representation of said imagewise exposure.

23. A method according to claim 22 wherein the image formation comprises the step of digitizing the first electronic image representation formed from the imagewise exposed, developed, and scanned imaging element to form the digital image.

24. A method according to claim 18 wherein the image formation comprises the step of modifying a first electronic image representation formed from and imagewise exposed, developed, and scanned imaging element formulated to form a second electronic image representation.

25. A method according to claim 18 comprising storing, transmitting, printing, or displaying an electronic image representation of an image derived from an imagewise exposed, developed, and scanned imaging element.

* * * * *